US007275869B2

(12) United States Patent
Moizumi

(10) Patent No.: US 7,275,869 B2
(45) Date of Patent: Oct. 2, 2007

(54) INNER BAG FOR TRANSPORT TANK AND PRODUCING METHOD THEREOF

(75) Inventor: Yoshitsugu Moizumi, Shizuoka (JP)

(73) Assignee: Fujifilm Corporation, Tokyo (JP)

( * ) Notice: Subject to any disclaimer, the term of this patent is extended or adjusted under 35 U.S.C. 154(b) by 132 days.

(21) Appl. No.: 11/038,145

(22) Filed: Jan. 21, 2005

(65) Prior Publication Data

US 2005/0181922 A1 Aug. 18, 2005

(30) Foreign Application Priority Data

Jan. 22, 2004 (JP) ..... 2004-014697
Mar. 8, 2004 (JP) ..... 2004-064595

(51) Int. Cl.
*B65D 90/04* (2006.01)

(52) U.S. Cl. ..... 383/109; 383/107; 383/114

(58) Field of Classification Search ..... 383/109, 383/107, 78, 113, 88–91, 114; 220/495.01, 220/495.05, 495.06
See application file for complete search history.

(56) References Cited

U.S. PATENT DOCUMENTS 3,768,724 A * 10/1973 Hill ..... 206/523
3,956,045 A * 5/1976 Hoffman ..... 156/73.4
4,658,433 A * 4/1987 Savicki ..... 383/63
5,066,290 A * 11/1991 Measells et al. ..... 604/408

FOREIGN PATENT DOCUMENTS

| | | |
|---|---|---|
| JP | 50-4615 | 1/1975 |
| JP | 57-46492 U | 3/1982 |
| JP | 61-48190 U | 3/1986 |
| JP | 61-104983 A | 5/1986 |
| JP | 2001-354292 A | 12/2001 |

* cited by examiner

*Primary Examiner*—Nathan J. Newhouse
*Assistant Examiner*—Jack Morgan
(74) *Attorney, Agent, or Firm*—Birch, Stewart, Kolasch & Birch, LLP

(57) ABSTRACT

An inner bag for a transport tank is constituted of a doubled tubular film in which a tubular film is inserted into another one. An inner bag supply-discharge opening is thermally welded to an attachment hole formed in the doubled tubular film. When thermally welding one end of the doubled tubular film, a reinforcing film is put on a two-layered portion constituted only of an outer tubular film, so that the two-layered portion has the same thickness as a four-layered portion constituted of the outer and inner tubular films. Thereby, the whole thermal welding line has approximately uniform thickness such that the thinner portion dose not exist. This will prevent the deterioration in sealing property, strength and durability of the thermal welding line caused by rubbing of the thinner portion during transporting and or the application of welding energy to the thinner portion.

5 Claims, 13 Drawing Sheets

INNER BAG FOR TRANSPORT TANK AND PRODUCING METHOD THEREOF

BACKGROUND OF THE INVENTION

1. Field of the Invention

The present invention relates to an envelope type inner bag for a transport tank in which cargo is contained, and more specifically, to an envelope type, inner bag whose corner portions at both ends are reinforced and the producing method thereof.

2. Description of the Prior Arts

In cargo transportation by sea, railroad, road and so forth, a tank container is generally used for liquid materials (cargo). As the tank container, a 20 foot container (hereinafter referred to as a tank container) which conforms to the ISO Standards is ordinarily used, for example. The tank container has 20 foot length, 8 foot width, and 8 foot height, so that about 20 tons of liquid can be filled therein.

In the container transportation to use this kind of tank container, it is necessary to wash the inside of the tank after transportation, and in addition, to produce the tank by using a high quality stainless steel plate with chemical resistance. In order to solve the problems, Japanese Patent Laid-Open Publication No.S61-104983 discloses that an inner bag or liner bag which is made of soft synthetic resin to have the chemical resistance is loaded in the tank produced from the general steel plate. In addition, Japanese Patent Laid-Open Publication No.2001-354292, Japanese Utility-Model Laid-Open Publication No.S61-48190, Japanese Patent Laid-Open Publication No.S50-4615, and Japanese Utility-Model Laid-Open Publication No.S57-46492 also disclose to load the inner bag in the tank in order to save the trouble for washing the inside of the tank.

However, with respect to the prior art inner bag to be used in the tanks and tank containers, it is so difficult to produce appropriate inner bags for large tanks including the 20 foot container that there has no practical application. Namely, it has been difficult to produce the inner bag fitting in the cylindrical 20 foot container easily and affordably. The ideal inner bag to fit within the tank container properly would be a cylindrical-shaped inner bag having approximately the same shape as the tank container. However, it is necessary to prepare circular lid films, and in addition, to weld the circular lid films on both ends of a tubular film. To make matters worse, since the circular lid film has to be welded not in a two-dimensional direction, but in a three-dimensional direction, the exclusive guide apparatus for welding the circular lid film is required.

In contrast, an envelope type inner bag is easily produced only by welding the both ends of the tubular film. This type of inner bag prevents the liquid from directly contacting with the inside of the tank by joining supply-discharge openings of the inner bag and the tank. Therefore, changing the inner bag makes it unnecessary to wash the inside of the tank. However, since corner portions at both ends of the envelope type inner bag are square to protrude, if filler is filled therein, the corner portions are pressed against an inner wall of the tank container. Therefore, the corner portion is rubbed against the tank due to the vibration during transporting, so that it may be damaged from the end portion of a welding line. Although the envelope type inner bag can be produced easily, strength and durability of the corner portion go down easily due to the shape in comparison with other parts, so that the practical application of the envelope type inner bag has been hampered.

Meanwhile, it may be considered to strengthen and ruggedize the corner portion by doubling the inner bag with inner and outer tubular films welded thermally at the both ends. However, mere doubling and welding at both ends make difference in thickness in the corner portions at both ends, namely four-layered portions formed by doubling and two-layered portions constituted only of the outer tubular film. When all the corner portions are welded together, the same welding energy is applied to both the four-layered portions and the two-layered portions, so that the thickness in the two-layered portions become thinner due to the application of heat. The result is a problem that the strength of the corner portion goes down.

SUMMARY OF THE INVENTION

An object of the present invention is to provide an envelope type inner bag for a transport tank, in which sealing property, strength and durability of the inner bag are enhanced by reinforcing corner portions at both ends of an inner bag body, and a producing method thereof.

In order to achieve the above object, an envelope type inner bag for the transport tank of the present invention includes a synthetic-resin multilayer tubular film constituted of outer and inner tubular films, a synthetic-resin reinforcing film to be put on both ends of the multilayer tubular film, a welding line formed by welding both ends of the multilayer tubular film together with the reinforcing film, and a second supply-discharge opening to be fitted in a first supply-discharge opening disposed in a lower portion of the transport tank. The multilayer tubular film is at least doubled with two layers including the inner and outer tubular films. An envelope type inner bag is completed after sealing the ends of the multilayer tubular film by the welding line. A hole to attach the second supply-discharge opening is formed in the multilayer tubular film. The second supply-discharge opening is welded to a peripheral edge of the hole before forming the welding line.

Furthermore, in a producing method of the inner bag for the transport tank of the present embodiment, a tubular film is inserted into another one after cutting these films from a synthetic-resin tubular film to form a multilayer tubular film having at least two layers. Subsequently, a welding line is formed in a width direction by welding to seal one end of the multilayer tubular film in a bag shape. In forming the welding line, both ends of the welding line are reinforced by putting the reinforcing film thereon. A hole penetrating inside the multilayer tubular film is formed on one surface of the multilayer tubular film, and then a second supply-discharge opening is welded to the hole. The welding line is formed in a width direction with welding to seal an other end of the multilayer tubular film attached with the second supply-discharge opening in a bag shape. The welding line is reinforced by putting a reinforcing film on corner portions at both ends thereof in forming the welding line.

According to the preferred embodiment of the present invention, the reinforcing film is folded and disposed to sandwich a position constituted only of the outer tubular film at both ends of the welding line. Both ends of the welding line have a linear first welding line portion or a circular-arc second welding line portion which turn inward of the multilayer tubular film. When length of the multilayer tubular film is IL, width thereof is IW, an inner peripheral length of the transport tank in a longitudinal cross-sectional surface in a longitudinal direction is TLt, and the inner peripheral length of the transport tank in the longitudinal cross-sectional surface in a width direction is TLr, the following conditions are satisfied: $0.47 \cdot TLt \leqq IL \leqq 0.6 \cdot TLt$, $0.47 \cdot TLr \leqq IW \leqq 0.6 \cdot TLr$.

In another embodiment of the present invention, the reinforcing film is formed by folding the corner portions at both the ends of the multilayer tubular film.

According to the present invention, since the inner bag is formed to be an envelope shape, it is unnecessary to form an approximately tubular inner bag body having approximately the same shape as the transport tank. In addition, the reinforcing film is put on both ends of the multilayer tubular film, and then the welding line is formed by sealing both ends. Since the corner portions of the inner bag are reinforced by the reinforcing film, if the corner portions are rubbed against the inside of the transport tank, the durability of the inner bag body does not go down.

In both ends of the welding line, in order to eliminate difference in thickness between the inner tubular film and the outer tubular film which covers the inner tubular film, the thickness in the welding line is uniformed by welding the reinforcing film together with the corner portion constituted only of the outer tubular film, so that the two-layered portion disappears. Accordingly, since approximately uniform heat energy is applied to the corner portion in the welding, the damage of the welding line caused by the application of the excessive heat energy is eliminated, maintaining the strength of the welding line in uniform. Namely, when the tubular film is multilayered, a gap between the outer tubular film and the inner tubular film is there at both side edges of the multilayer tubular film. Thereby, the portion where only the outer tubular film resides is a two layer, while the portion where the outer and inner tubular films overlaidly reside is a four layer. Therefore, the difference in thickness in the welding line occurs between the two-layered portion and the four-layered portion. Since the welding energy is uniformly applied to the entire corner portion of the multilayer tubular film, the excessive welding energy is applied to the two-layered portion to damage there, so that the two-layered portion may not be able to endure the impact during transportation. To make matters worse, since the thickness of the two-layered portion becomes thinner by the application of the welding energy, the sealing property and the strength in the two-layered portion are insufficient, so that the two-layered portion is easily tore. Meanwhile, in the present invention, since the corner portions of the inner bag are welded after putting the reinforcing film thereon such that the entire welding line has uniform thickness, so that the sealing property and the strength of the corner portions are ensured.

In addition, both end portions of the welding line are formed as an oblique line or a circular-arc line which turns inward of the tubular film, so that the protrusion of the corner portions at both ends caused by the internal liquid pressure becomes small in scale. Moreover, since the force to a weaker sealing portion in the welding line becomes reduced, the sealing property, the strength and the durability of the corner portion are ensured all the more.

BRIEF DESCRIPTION OF THE DRAWINGS

The above and other subjects and advantages of the present invention will become apparent from the following detailed description of the preferred embodiments when read in association with the accompanying drawings, which are given by way of illustration only and thus are not limiting the present invention. In the drawings, like reference numerals designate like or corresponding parts throughout the several views, and wherein.

DETAILED DESCRIPTION OF THE PREFERRED EMBODIMENTS

Figure 1:
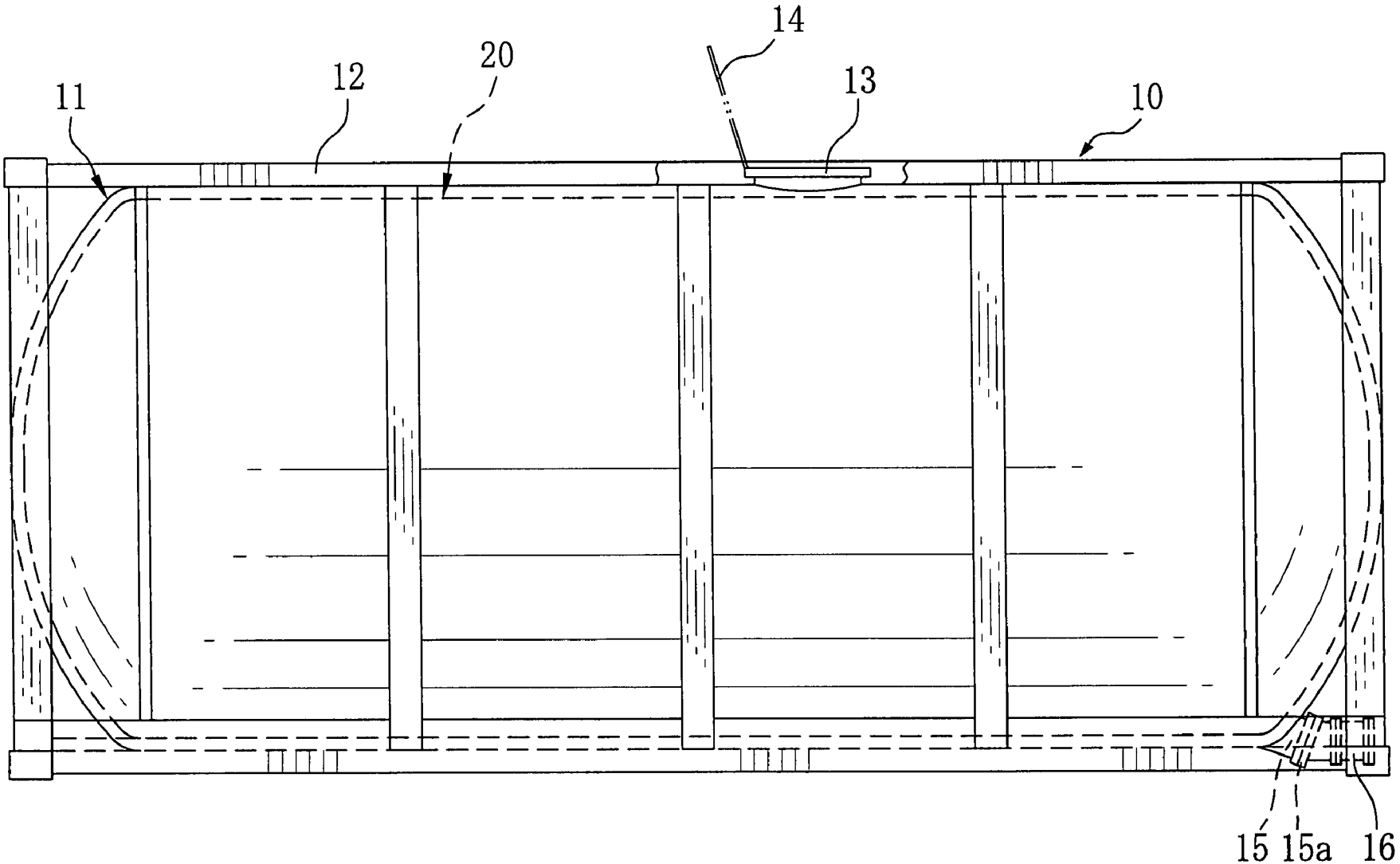
FIG. 1 is a front view of a tank container in which an inner bag for a transport tank of the present invention is loaded.

In FIG. 1, a twenty-foot ISO container 10 is constituted of a tank body 11 and a frame 12 for holding the tank body 11. A hatch 13 is-formed at the top face of the tank body 11. The maintenance and filling of liquid are performed through the hatch 13. At the time of transporting, a lid 14 is locked by a locking member in order to prevent the lid 14 covering the hatch 13 from opening. A tank supply-discharge opening 15 is formed in one end of a lower part of the tank body 11. A foot valve 16 is fixed through a flange 15*a* of the tank supply-discharge opening 15.

An inner bag for a transport tank (hereinafter referred to as an inner bag) 20 is set into the tank body 11. The inner bag 20 is brought into the tank body 11 from the hatch 13 by an operating person to load in the tank body 11. The inner bag 20 upswells in the tank body 11 by pouring the liquid as cargo therein from the tank supply-discharge opening 15 through the foot valve 16, so that the inner bag 20 operates as a lining to the tank body 11.

Figure 2A:
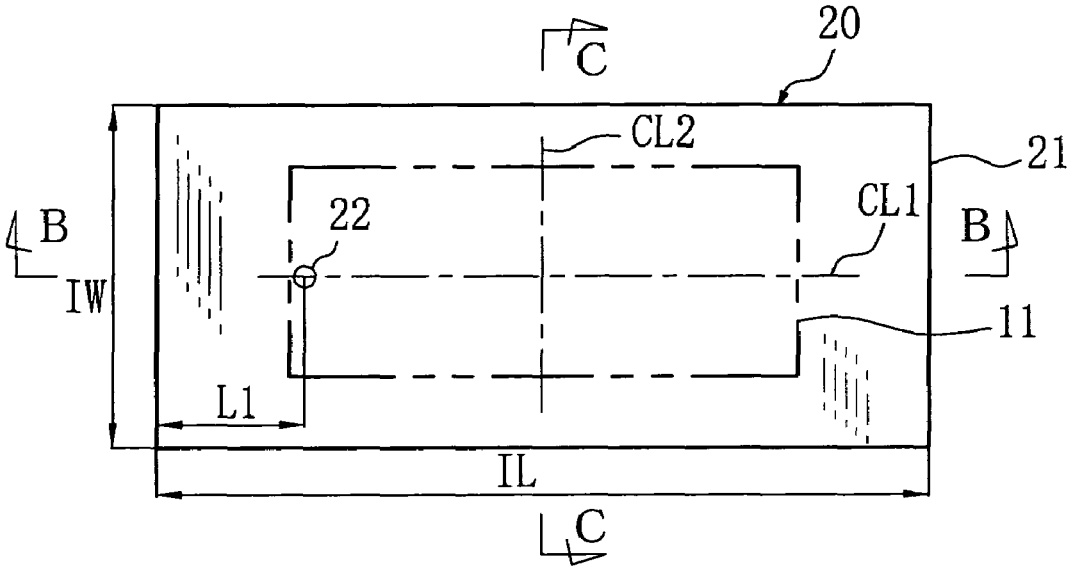
FIG. 2A is an explanatory view of the size of the inner bag fitting in a tank body of the transport tank, wherein a plan view of the tank body and the inner bag is shown.
Figure 3A:
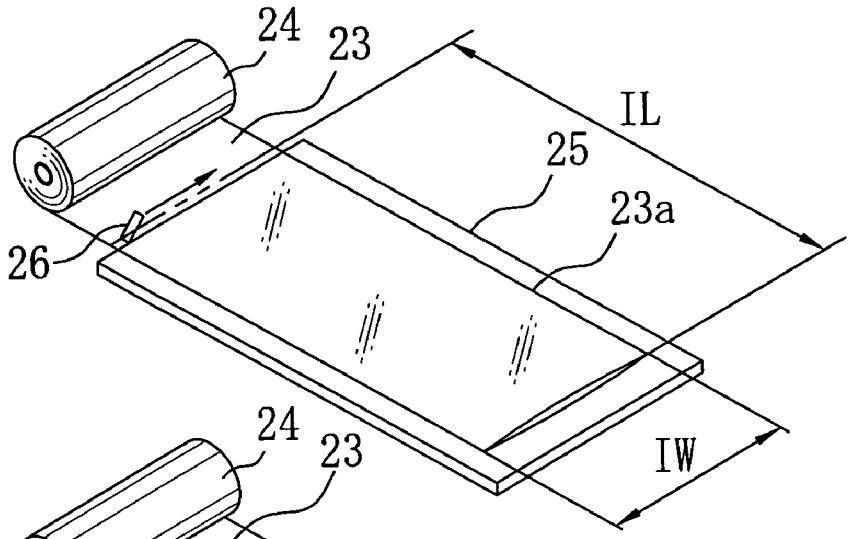
FIGS. 3A, 3B, 3C and 3D are schematic perspective views showing procedure for producing the inner bag.
Figure 3B:
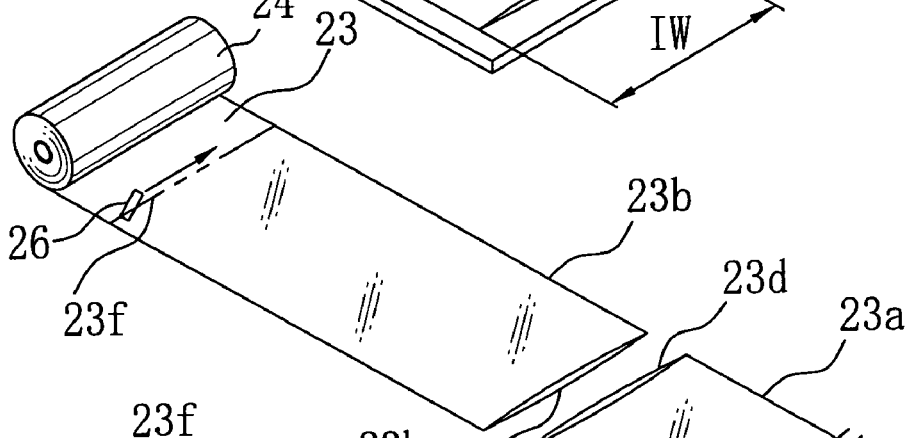

As shown in FIG. 2A, the inner bag 20 is constituted of an inner bag body 21 having an envelope shape and an inner bag supply-discharge opening 22 to be fitted in the tank supply-discharge opening 15. Since the inner bag 20 is formed to the envelope shape, the inner bag body 21 can be easily formed as shown in FIGS. 3A-3D. In FIG. 3B, a tubular film 23 is cut into a predetermined length after being drawn from a film roll 24 which is the roll of the tubular film 23, and then end portions 23*c*-23*f* of the two tubular films 23*a* and 23*b* are closed by thermally welding or the like (see FIGS. 7A and 7C).

Figure 2B:
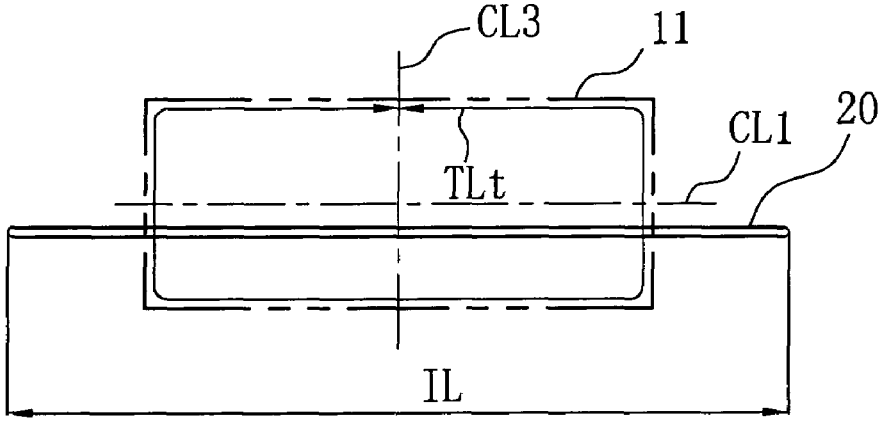
FIG. 2B is an explanatory view of the size of the inner bag fitting in the tank body, wherein a longitudinal cross-sectional surface of the tank body in a longitudinal direction is shown.
Figure 2C:
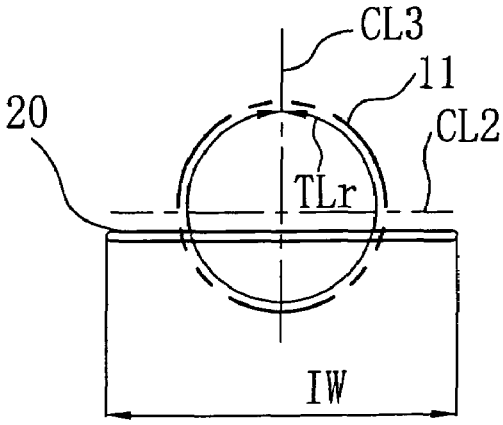
FIG. 2C is an explanatory view of the size of the inner bag fitting in the tank body, wherein a longitudinal cross-sectional surface of the tank body in a width direction is shown.

In FIG. 2A, a longitudinal cross-sectional surface including a central line CL1 extending in the longitudinal direction of the tank body 11 (B-B arrowed cross-sectional surface) is referred to as a longitudinal cross-sectional surface in the longitudinal direction, while a longitudinal cross-sectional surface including a central line CL2 extending in the width direction of the tank body 11 (C-C arrowed cross-sectional surface shown by the arrow) is referred to as a longitudinal cross-sectional surface in the width direction. A line CL3 shown in FIG. 2B is a central line extending in a height direction of the tank body 11.

The tank body 11 is formed to a tubular shape whose both ends are closed to be placed transversally, while the inner bag 20 is formed to the envelope shape. Therefore, if the inner bag 20 is smaller than the appropriate size corresponding to the size of the tank body 11, a predetermined filling capacity is not ensured. To make matters worse, the smaller inner bag creates a gap between the inner peripheral surface of the tank body 11 and the inner bag 20 where the inner bag 20 together with the liquid can move to damage the welded portion of the inner bag supply-discharge opening 22 and the welding lines of the both ends of the inner bag 20. Whereas, if the inner bag 20 is larger than the appropriate size corresponding to the size of the tank body 11, the raw material of the inner bag 20 is wasted. Moreover, if an extra portion such as the end portion of the inner bag 20 is under the liquid filled in the inner bag 20, the extra portion is sandwiched between the inner bag body 21 filled with the liquid and the peripheral surface of the tank body 11 due to the weight of the liquid. As a result, it becomes impossible to fill any further liquid. If the liquid is kept filled while the extra portion is sandwiched, the internal pressure of the inner bag 20 rises to possibly damage the inner bag 20.

In the present embodiment, the size of the envelope type inner bag 20 is limited within a specific range based on the size of the tank body 11 for the purpose of preventing the filling failure and the damage of the inner bag 20. When the length of the inner bag 20 is IL, the width thereof is IW, the inner peripheral length (first inner peripheral length) of the tank body 11 in the longitudinal cross-sectional surface in the longitudinal direction is TLt, and the inner peripheral length (second inner peripheral length) of the tank body 11 in the longitudinal cross-sectional surface in the width direction is TLr, the following conditions are satisfied:

$$0.47 \cdot TLt \leqq IL \leqq 0.6 \cdot TLt; \text{ and}$$

$$0.47 \cdot TLr \leqq IW \leqq 0.6 \cdot TLr.$$

IL and IW preferably satisfy the following conditions:

$$0.49 \cdot TLt \leqq IL \leqq 0.55 \cdot TLt; \text{ and}$$

$$0.49 \cdot TLr \leqq IW \leqq 0.58 \cdot TLr.$$

As above-mentioned, the size of the inner bag 20 is limited based on the inner peripheral length of the tank body 11, so that the tank body 11 may have different shapes than tube such as an elliptical shape or others.

The inner bag supply-discharge opening 22 is provided on the central line extending in the longitudinal direction at a position apart from one end of the inner bag 20 by the distance L1=1750 mm or adjacent thereto. The distance L1 is limited within a range $0.44 \cdot IW \leqq L1 \leqq 0.50 \cdot IW$ based on the width IW of the inner bag 20, so that it is possible to position the central positions in the longitudinal direction of the tank body 11 and the inner bag 20 with each other if the inner bag 20 is attached to the tank body 11 with reference to the tank supply-discharge opening 15, which is formed in the end of the lower part of the tank body 11. Thereby, the extra portions in the both ends of the inner bag 20 can be distributed approximately evenly in the tank body 11. Accordingly, the extra portion of the inner bag 20 does not build up on one side to be sandwiched between the tank body 11 and the inner bag body 21, so that the filling failure and the damage of the inner bag 20 are eliminated.

Figure 4:
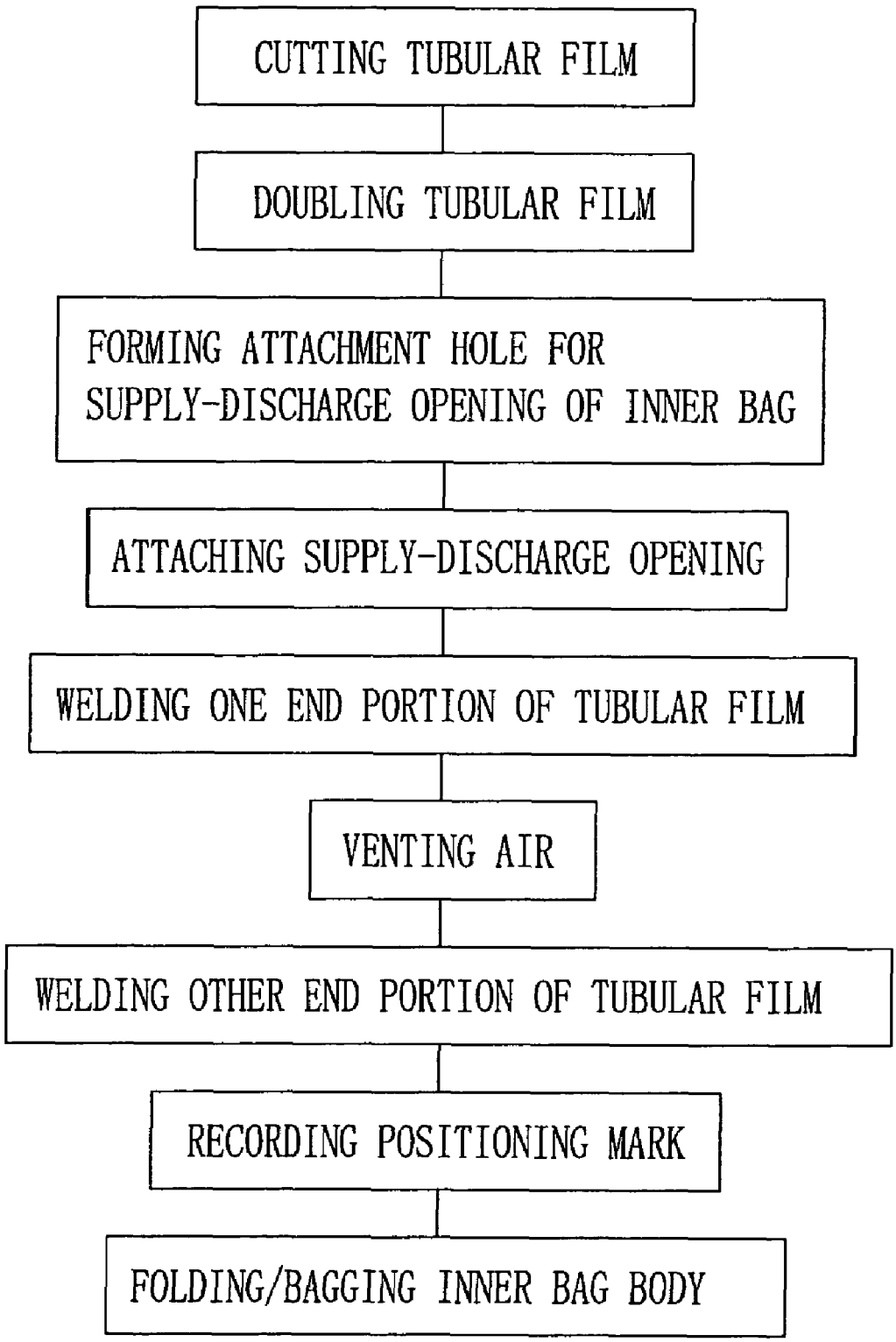
FIG. 4 is a flow chart showing the procedure for producing the inner bag.

Next, the procedure for producing the inner bag 20, which is shown in FIG. 4, is explained. As shown in FIGS. 3A and 3B, the tubular film 23 is drawn from the film roll 24 to be put on a work table 25, and then cut into the length IL by a cutter 26 or the like. The tubular film 23 is made from LLDPE (linear low density polyethylene), and wound into a roll shape to be stored. Since the inner bag 20 is doubled in the present embodiment, it is necessary to form the two tubular films 23*a* and 23*b* by cutting the tubular film 23 twice into the length IL. The inner bag 20 of the present invention is used for the 20 foot container, so that the first inner peripheral length TLt≈15500 mm, and the second inner peripheral length TLr≈7100 mm, while IL=8300 mm and IW=3900 mm based on the above-mentioned appropriate size range. The thickness of a single layer of the tubular film 23 is 120 μm. Since the tubular film 23 of the present embodiment has two layers, the entire thickness of the tubular film 23 is 240 μm. The thickness of the film is preferably 80-500 μm, especially 100-300 μm.

Figure 3C:
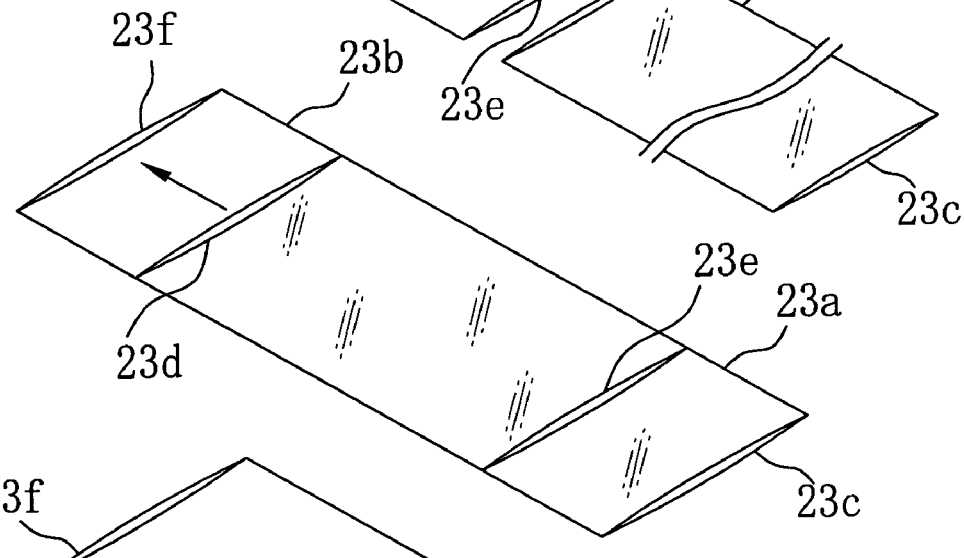
Figure 3D:
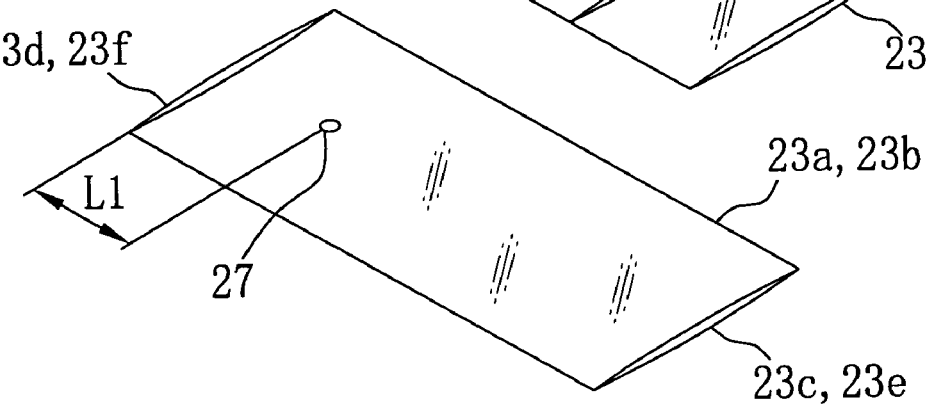

As shown in FIG. 3C, in doubling the tubular films 23*a* and 23*b*, one tubular film 23*a* is inserted into another tubular film 23*b*. Subsequently, as shown in FIG. 3D, a hole 27 corresponding to the inner bag supply-discharge opening 22 is opened on only the upper two layers of films by a punch or a cutter. The inner bag supply-discharge opening 22 is located at the center in the width direction and apart from other end portion 23*d* by the distance L1=1750 mm.

Figure 5:
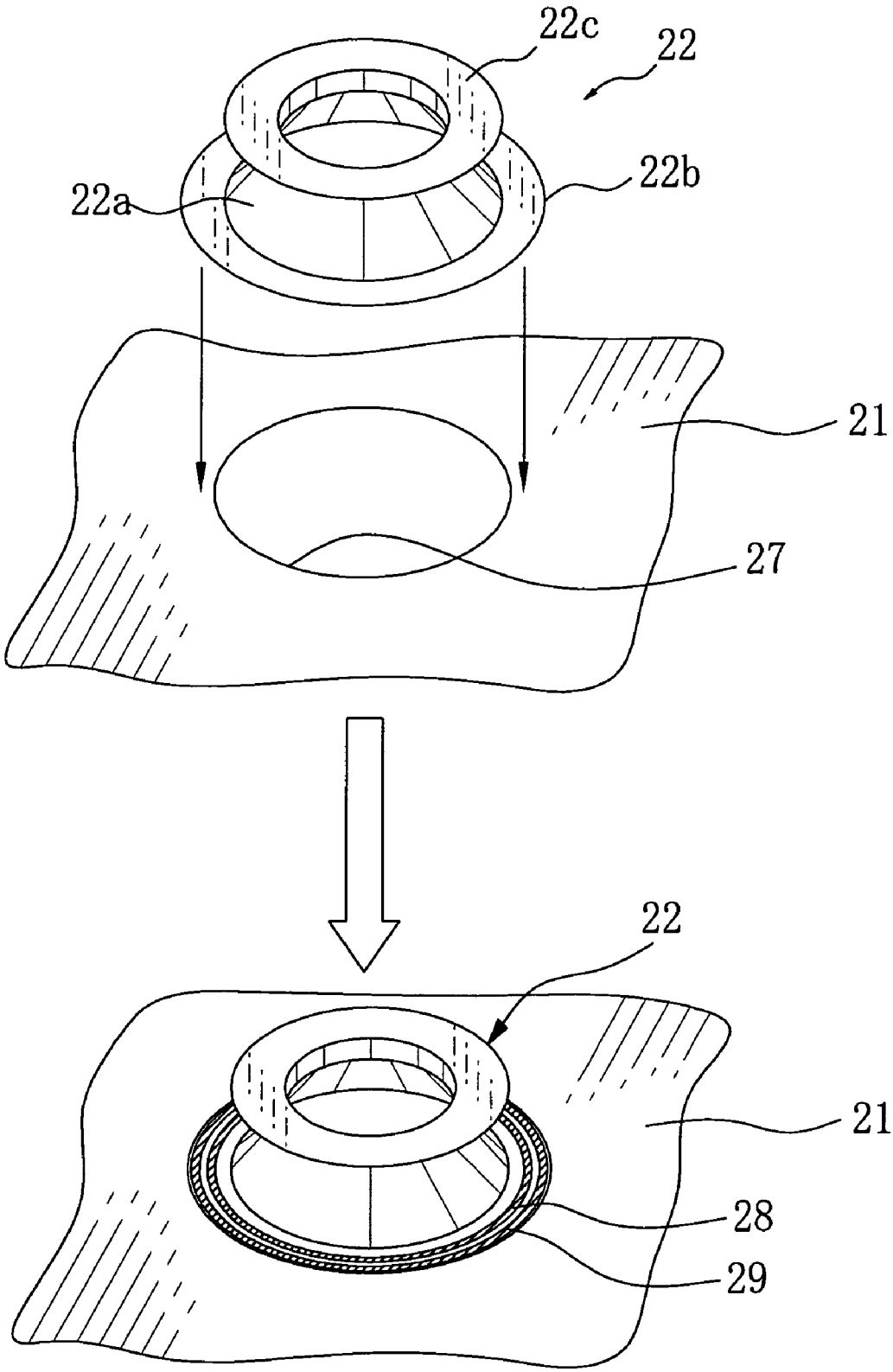
FIG. 5 is an explanatory view showing procedure for welding an inner bag supply-discharge opening.
Figure 6:
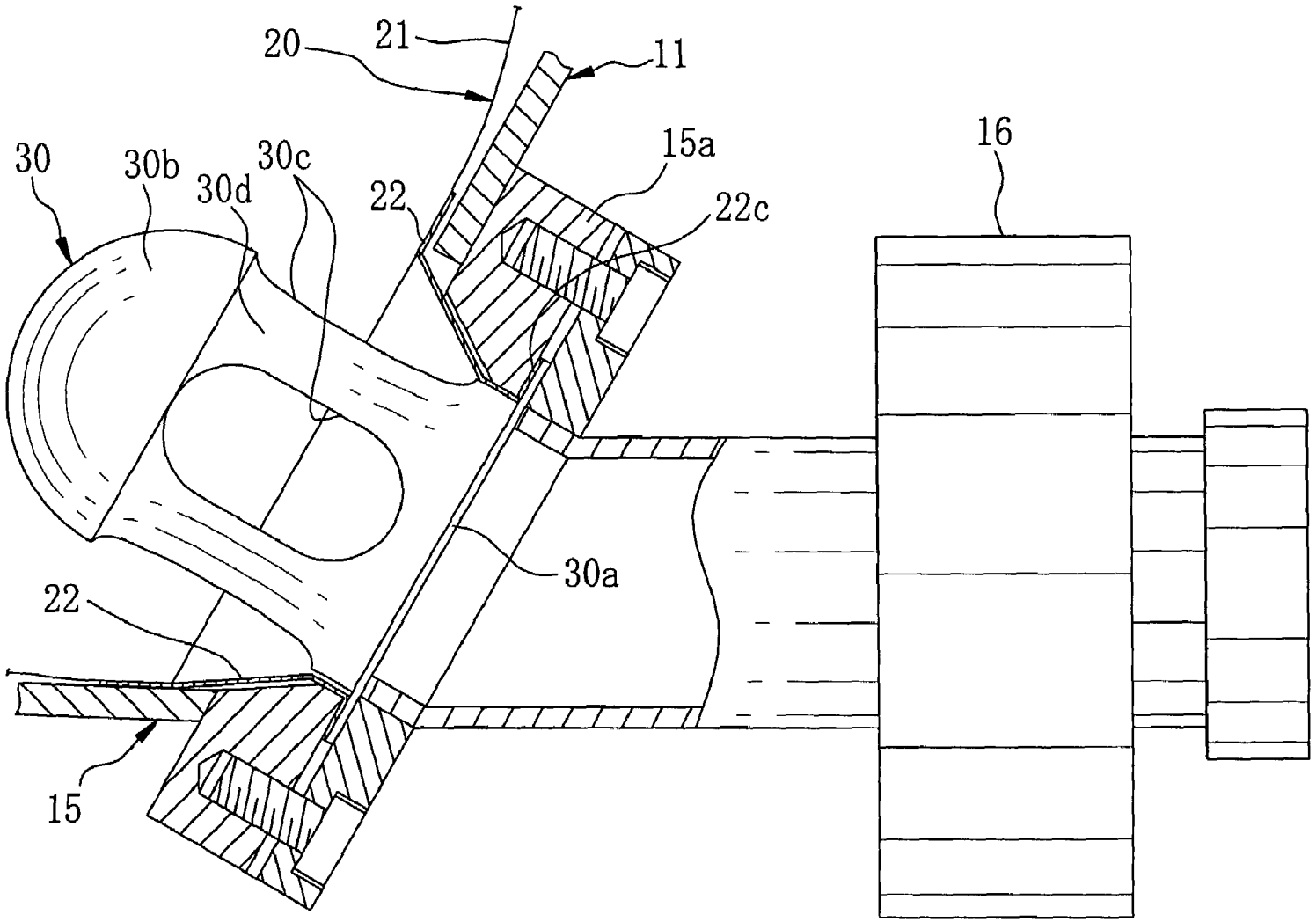
FIG. 6 is a cross-sectional view showing a state where the inner bag supply-discharge opening is attached to a tank supply-discharge opening.

As shown in FIG. 5, when the inner bag supply-discharge opening 22 is attached to the inner bag body 21, the opening 22 is thermally welded to a peripheral edge of the hole 27. At this time, only the upper two layers of the films are thermally welded. The inner bag supply-discharge opening 22 is constituted of a supply-discharge mouth 22*a* having a truncated conical and cylindrical shape, a welding flange 22*b* and an attachment flange 22*c* which are attached to both the ends of the supply-discharge mouth 22*a*, and integrally formed by using LLDPE for example. The welding flange 22*b* and the inner bag body 21 are thermally welded by a thermal welding apparatus (not shown) to form welding lines 28 and 29. As shown in FIG. 6, when the inner bag supply-discharge opening 22 is inserted to the tank supply-discharge opening 15 from the inside of the tank, the attachment flange 22*c* protrudes outside the flange 15*a* of the tank supply-discharge opening 15 to be fixed firmly to the flange 15*a*.

As shown in FIG. 6, a flange 30*a* of an inner bag suction preventing member 30 and the foot valve 16 are attached to the flange 15*a* of the tank supply-discharge opening 15, so that the inner bag supply-discharge opening 22 is attached firmly to the tank supply-discharge opening 15. The supply-discharge mouth 22*a* is formed along the inner peripheral surface of the tank supply-discharge opening 15.

Figure 7A:
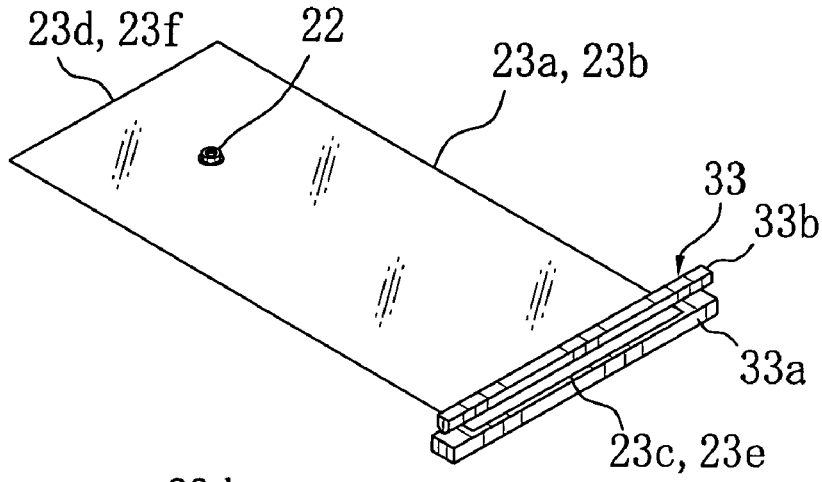
FIG. 7A is a perspective view showing process for welding one end of a tubular film.

As shown in FIG. 7A, in welding the one end portion of the tubular film 23, all four layers of films in the end portions 23*c* and 23*e* of the tubular films 23*a* and 23*b* are thermally welded simultaneously by the thermal welding apparatus 33 to seal the end portions 23*c* and 23*e*. The thermal welding apparatus 33 is constituted of a receiving stage 33*a* and a welding head 33*b*. The heat is applied to the end portions 23*c* and 23*e*, which are held by the welding head 33*b* and the receiving stage 33*a* after the welding head 33*b* has been moved down.

Figure 8A:
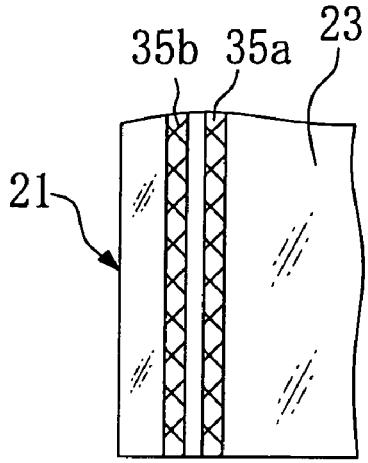
FIG. 8A is an enlarged plan view showing a thermal welding line of the inner bag, wherein inner and outer tubular films are thermally welded all together into four layer.
Figure 8B:
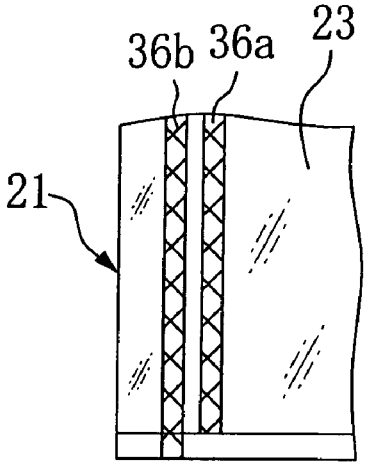
FIG. 8B is an enlarged plan view showing the thermal welding line of the inner bag, wherein the inner and outer tubular films are thermally welded all together into four layer after the end of the inner tubular film have been thermally welded into two layer.
Figure 8C:
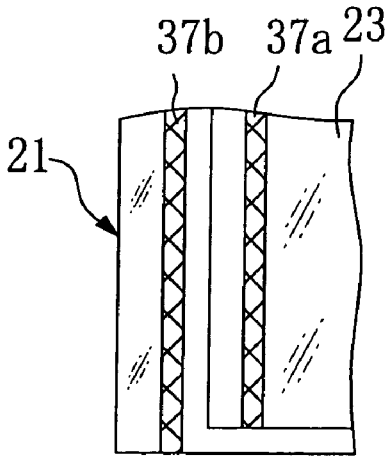
FIG. 8C is an enlarged plan view showing the thermal welding line of the inner bag, wherein the ends of the inner and outer tubular films are thermally welded together into two layer.

As shown FIGS. 8A-C, two stripes of thermal welding lines 35*a* and 35*b* of 5 mm in width are formed linearly at an interval of 5-10 mm. Note that one or three or more thermal welding lines may be formed. In addition, a corrugated thermal welding line may be applied to the present embodiment instead of the linear one. If the plural thermal welding lines are formed, all lines may be formed together, or each line may be formed one by one. In FIG. 8B, a thermal welding line 36*a* is formed by welding the end portion 23*e* of the inner tubular film 23*b*, and then a thermal welding line 36*b* is formed by welding the end portions 23*c* and 23*e* of the outer and inner tubular films 23*a* and 23*b* into four layer at the outer side of the welding line 36*a*. The thermal welding line 36*b* is positioned outside the thermal welding line 36*a*. In FIG. 8C, thermal welding lines 37*a* and 37*b* are formed by welding the end portions 23*c* and 23*e* of the tubular films 23*a* and 23*b* into two layer separately wherein the inner tubular film 23*a* is slightly shorter in length than the outer tubular film 23*b*. Although the thermal welding line may be welded at a time, if the length of the welding head 33*b* is limited, the thermal welding line may be welded sequentially every length of the welding head 33*b*. Note that the end portions of the tubular film 23 may be sealed by ultrasonic welding, other welding method or an adhesive agent, instead of the thermal welding by using the heat-sealing type thermal welding apparatus 33. In addition, the welding and the adhesion may be used together.

Figure 9A:
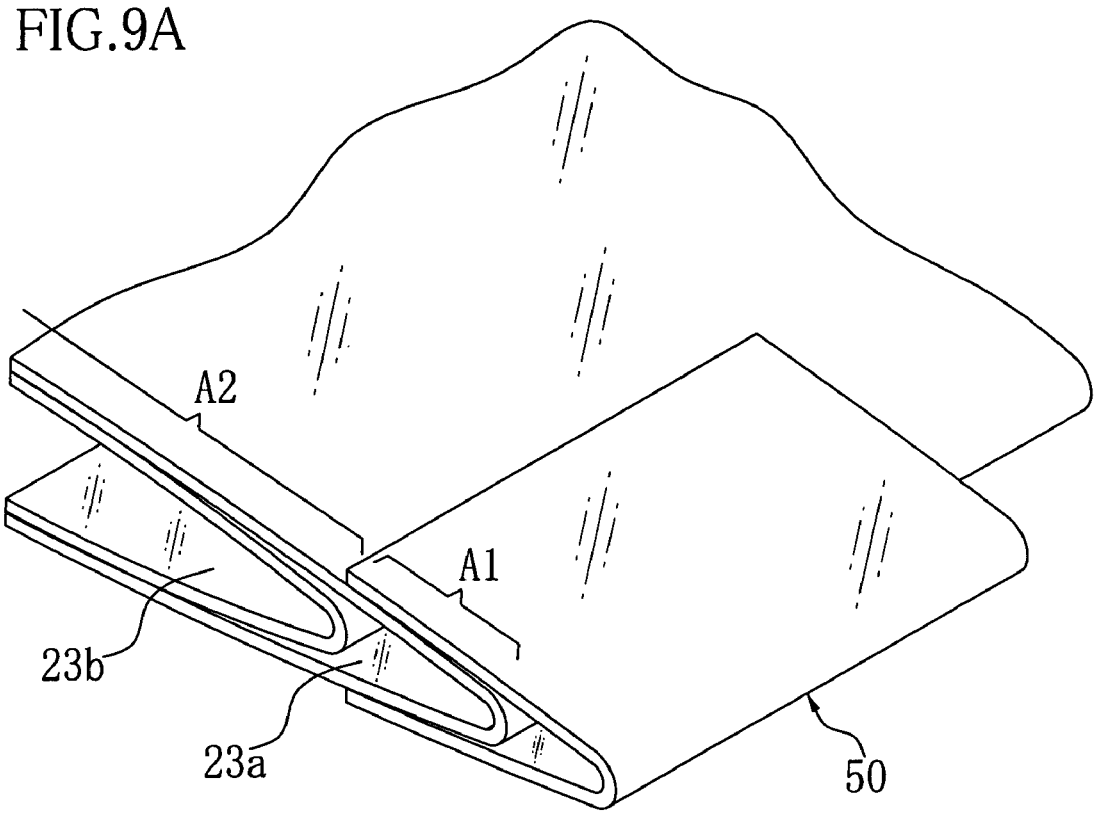
FIGS. 9A and 9B are perspective views showing an example that a corner portion of the tubular film is thermally welded with a reinforcing film such that the thickness in the thermal welding line is approximately uniformed.
Figure 9B:
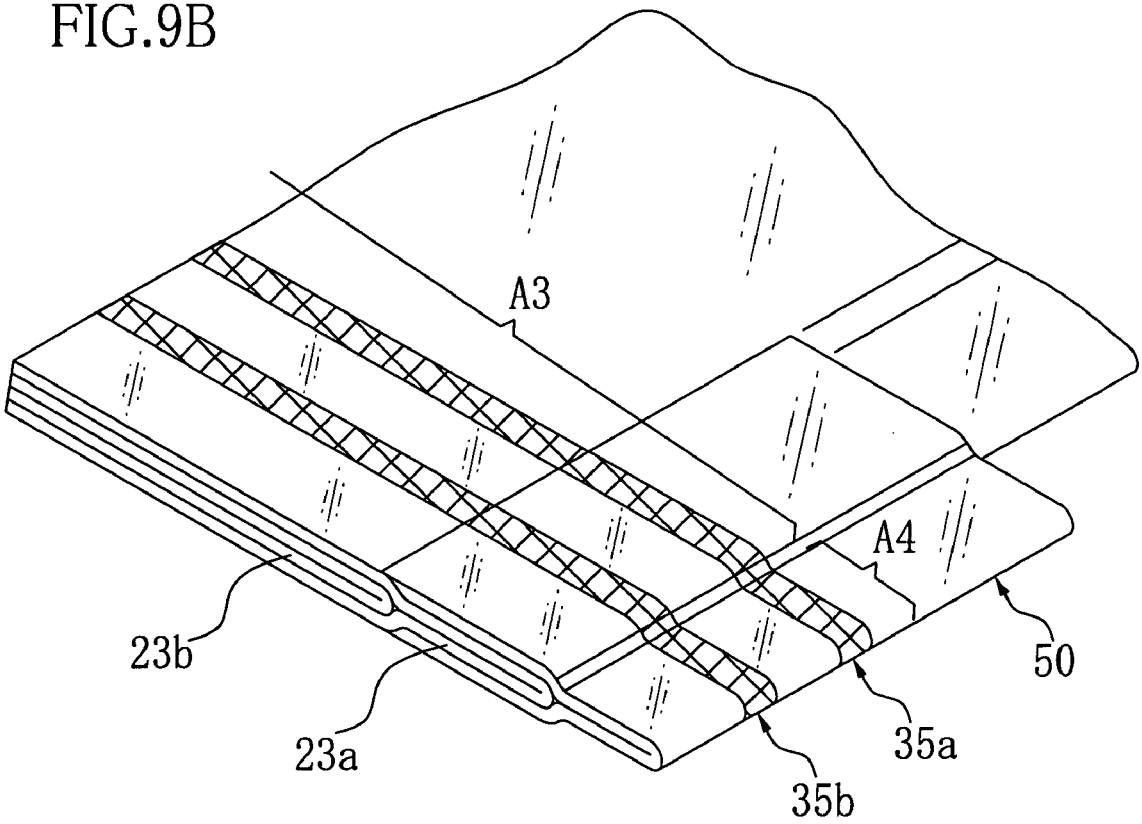

In FIGS. 8A-8C, the thermal welding lines 36*a*, 37*a* and 37*b* are formed on the single tubular films 23*a* and 23*b*, and have approximately uniformed thickness. Meanwhile, the thermal welding lines 35*a*, 35*b* and 36*b* are formed on the doubled tubular films 23*a* and 23*b*. Therefore, as shown in FIG. 9A, a two-layered portion (A1) including only the outer tubular film 23*a* without a reinforcing film 50 and a four-layered portion (A2) constituted of the outer and inner tubular films 23*a* and 23*b* are produced. Since the excessive welding energy is applied to the section A1 upon thermal welding, the welded part is damaged to lower the impact resistance in transporting. To make matters worse, since the thickness of the section A1 is thinner than the section A2 after the thermal welding, the sealing property and the strength in the section A1 become weak, so that the inner bag may be tore. As a result, the sealing property, the strength and the impact resistance in the section A1 are lowered. In the present embodiment, as shown in FIG. 9A, the section A1 is thermally welded so as to have a four-layered structure by putting thereon the reinforcing film 50 of the same material and thickness as the tubular film 23. Thereby, as shown in FIG. 9B, the thickness of the thermal welding lines 35*a* and 35*b* in the section A3 becomes approximately uniform. Consequently, the excessive heat energy is not applied partially, so that the sealing property, the strength and the impact resistance in the section A3 are not lowered.

Figure 10:
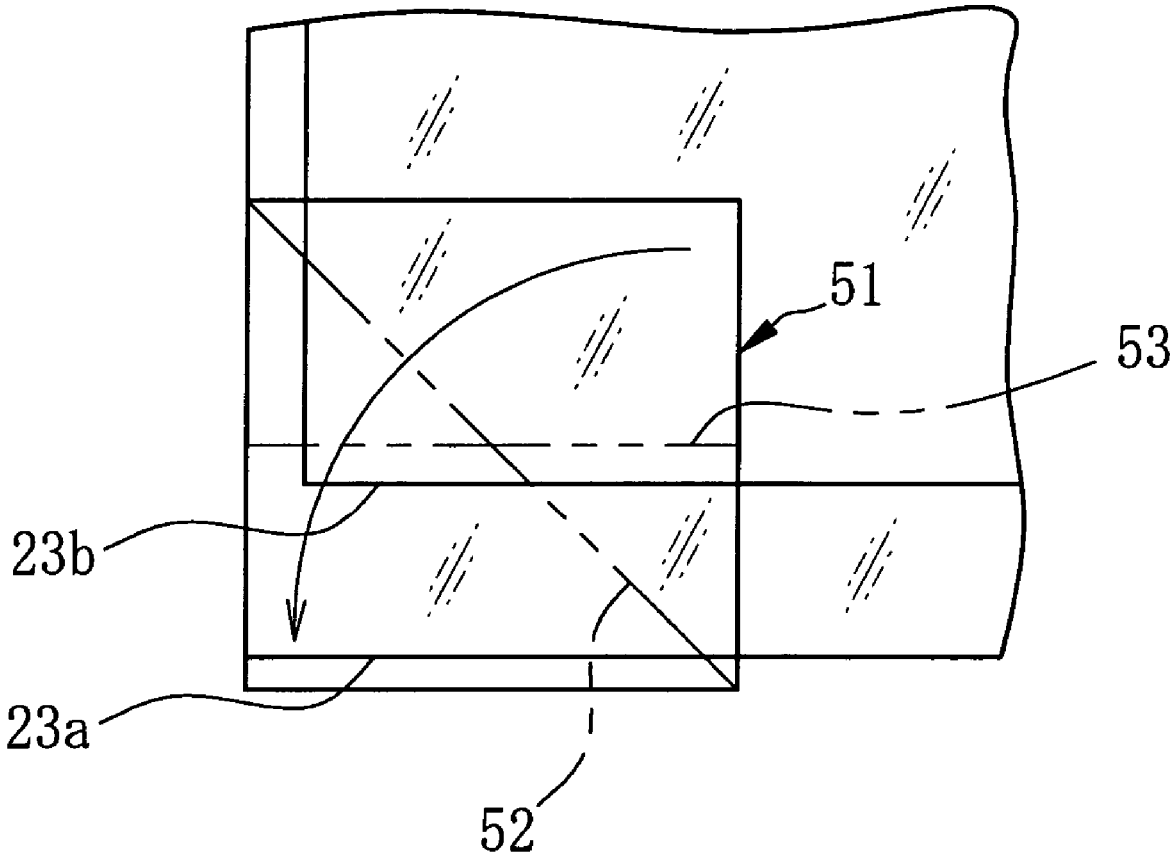
FIG. 10 is a plan view showing another example that the corner portion is thermally welded with the reinforcing film such that the thickness in the thermal welding line is approximately uniformed.

There is another method of reinforcing the corner portion of the inner bag body. As shown in FIG. 10, front and rear side portions of a reinforcing film 51 are folded diagonally along a folding line 52 to be thermally welded. In this case, the thickness of the reinforcing film 51 becomes twice, so that it is possible to reinforce the corner portion of the outer tubular film 23*a*. Instead of the folding line 52, the front and rear side portions of the reinforcing film 51 may be folded along a folding line 53 parallel to the side edge of the outer tubular film 23*a*. Moreover, the reinforcing film 51 may be thicker than the tubular film 23.

Figure 7B:
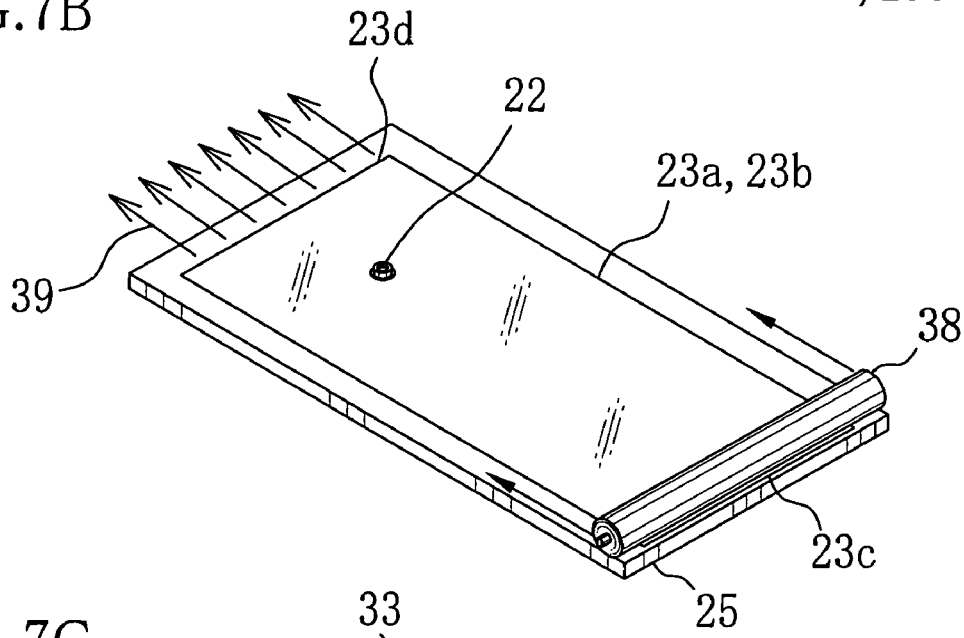
FIG. 7B is a perspective view showing process for venting air from the tubular film.

As shown in FIG. 7B, a pressing roller 38 is rotated on the work table 25 from the welded one end portion 23*c* toward the other end portion 23*d* to vent air 39 in the doubled inner bag body 21. Instead of rotating the pressing roller 38, the air39 may be vented by folding the inner bag body 21 from one end side to the other end side. Since the inner bag supply-discharge opening 22 is attached close to the other end portion 23*d* so as to protrude from the inner bag body 21, the air between the inner bag supply-discharge opening 22 and the other end portion 23*d* is vented by using a small roller for avoiding the supply-discharge opening 22.

Figure 7C:
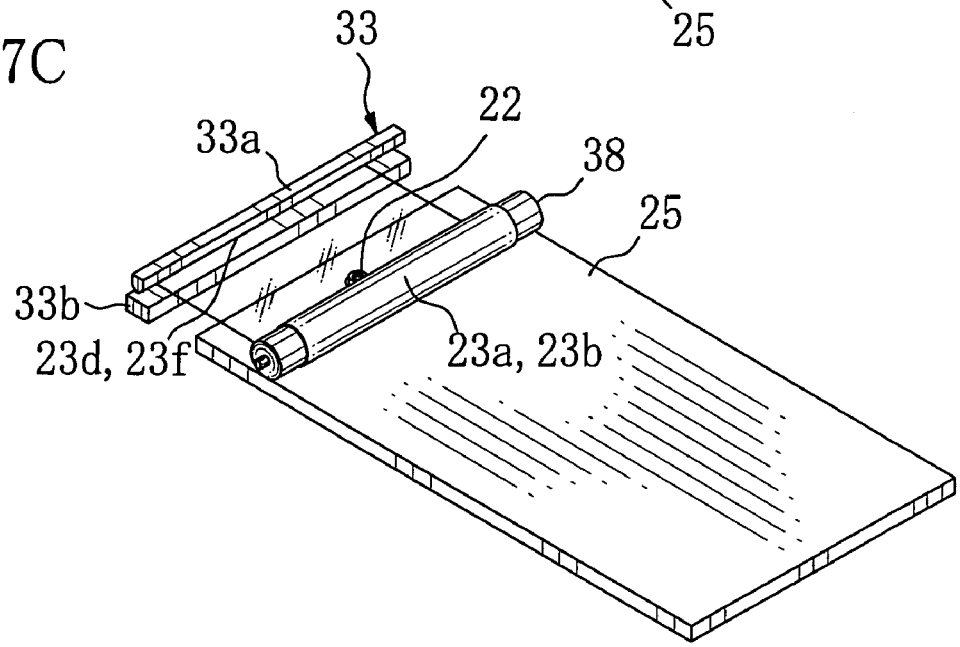
FIG. 7C is a perspective view showing process for welding the other end of the tubular film after the air venting.
Figure 11A:
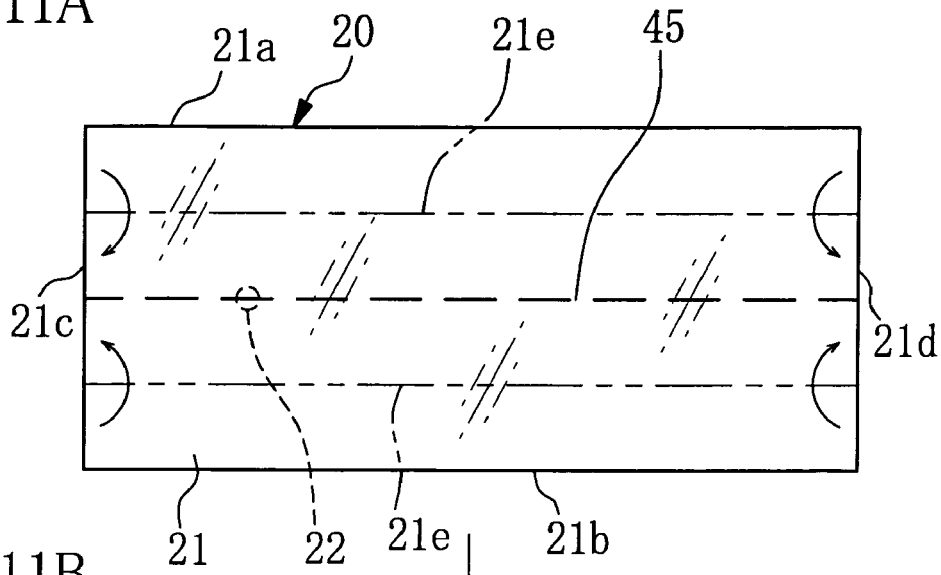
FIGS. 11A, 11B, 11C, 11D and 11E are explanatory views showing process for folding the inner bag to put it into a packaging bag.
Figure 11B:
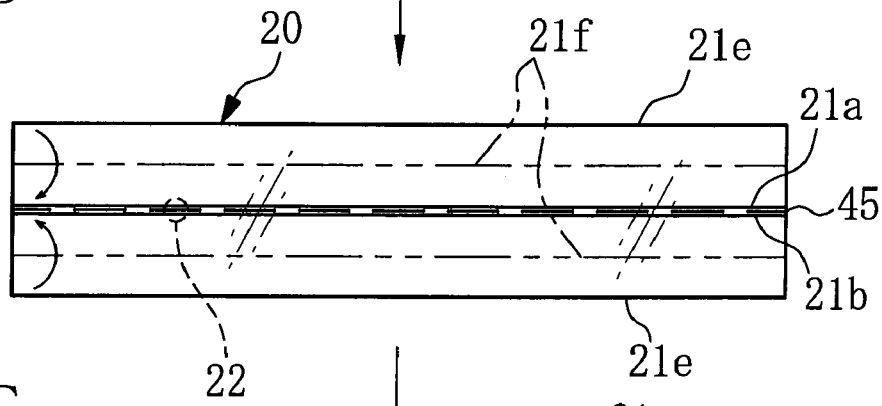
Figure 11C:
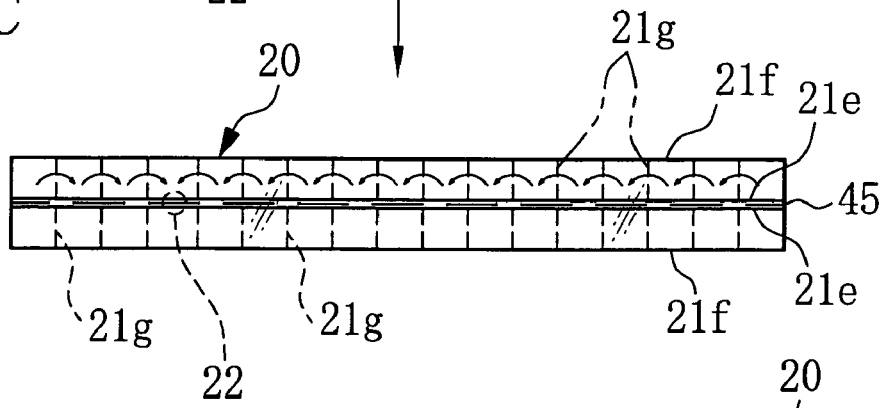
Figure 11D:
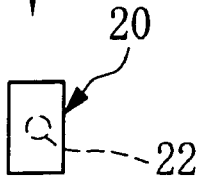
Figure 11E:
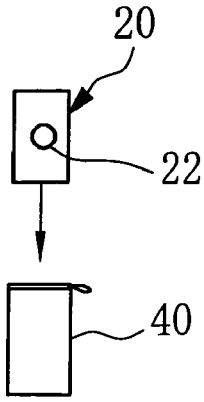

As shown in FIG. 7C, the other end portions 23*d* and 23*f* of tubular films 23*a* and 23*b*, in which the air has been vented, are welded by the thermal welding apparatus 33 in the same way as the one end portions 23*c* and 23*e*. Thereby, the inner bag 20 shown in FIG. 11A is completed. A positioning mark 45 is recorded along a central line extending in the longitudinal direction of the inner bag 20 by using an oil-based ink or the like. The inner bag body 21 is folded, and then contained in a packaging bag 40 as shown in FIG. 11E. Although the positioning mark 45 is formed linearly in the present embodiment, the shape or size of the positioning mark is not limited especially.

As shown in FIG. 11A, the inner bag body 21 with the supply-discharge opening 22 directed downward is folded inward along inward folding lines 21*e* in parallel with the positioning mark 45 so as to make both the side edge portions 21*a* and 21*b* approach the central line. Likewise, as shown in FIG. 11B, the inward-folded portions are folded inward again along inward folding lines 21*f* in parallel with the central line extending in the longitudinal direction so as to make the inward folding line 21*e* approach the central line. Thereby, the inner bag body 21 is double folded. Subsequently, as shown in FIG. 11C, the inner bag body 21 is folded plural times along the inward folding lines 21*g* toward the inner bag supply-discharge opening 22 from both the end portions 21*c* and 21*d* of the inner bag body 21, so that the inner bag body 21 is folded into a small size as shown in FIG. 11D. The inner bag body 21 may be rewound from the one end to be a roll shape instead of being folded inward along the inward folding lines 21*g*. After folding the inner bag body 21 into the small size, the inner bag 20 is put in the packaging bag 40 as shown in FIG. 11E. Since the inner bag body 21 is double folded along the inward folding lines 21*e* and 21*f*, it can be contained compactly. Note that the inner bag body 21 may be folded once or three times above along the central line extending in the longitudinal direction.

As aforementioned, since the inner bag body 21 is folded such that the inner bag supply-discharge opening 22 is directed outside the inner bag body 21, the inner bag supply-discharge opening 22 can be inserted to the tank supply-discharge opening 15 easily. In addition, the inner bag body 21 is folded inward along the inward folding lines 21*g*, so that the inner bag body 21 can be expanded easily in the longitudinal direction of the tank body 11 in a state that the inner bag supply-discharge opening 22 is set in the tank supply-discharge opening 15. Furthermore, since the inner bag body 21 is folded inward along each of the inward folding lines 21*e* and 21*f* in a state that the inner bag supply-discharge opening 22 is directed downward, the inner bag body 21 is expanded by itsel by filling the liquid from the inner bag supply-discharge opening 22.

Next, the method of loading the inner bag body 21 in the tank body 11 is explained. First, the inner bag 20 contained in the packaging bag 40 is brought into the tank body 11 by the operating person to be taken out of the packaging bag 40. The positioning mark 45 is recorded linearly on the inner bag 20 so as to correspond to the central liner CL1 extending in the longitudinal direction of the tank body 11. After the foot valve 16 has been removed from the flange 15*a* of the tank supply-discharge opening 15, the inner bag supply-discharge opening 22 is inserted in the tank supply-discharge opening 15 so as to conform the positioning mark 45 to the central line CL1. Thereby, the attachment flange 22*c* is attached firmly to the flange 15*a*. Second, the inner bag body 21 folded along the inward folding lines 21*g* is unfolded in the longitudinal direction of the tank body 11, and then the folded portions along the inward folding line 21*f* are unfolded. Both the side edge portions which is folded along the inward folding lines 21*e* are not unfolded. Since the approximately overall width of the inside of the tank body 11 is covered by the inner bag body 21 of which the both side edge parts are folded along the inward folding lines 21*e*, even if the both side edge portions are unfolded, they are folded again by their weight. After unfolding the inner bag body 21 except for both the side edge portions, the inner bag suction preventing member 30 and the foot valve 16 are attached to the tank supply-discharge opening 15 from the outside of the tank body 11 as shown in FIG. 6.

The liquid as the cargo is filled from the tank supply-discharge opening 15. The filling speed ,is 50 liters per minute, for example. The inner bag body 21 is extended in the longitudinal direction in the tank body 11, so that the inner bag body 21 upswells by filling the liquid in the inner bag body 21 smoothly. The both side edge portions of the inner bag body 21, which are folded inward, are gradually unfolded with the filling of the liquid, so that the end portions of the inner bag body 21 are not accidentally caught between the inner bag body 21 and the tank body 11 by the weight of the portion in which the liquid is filled. Therefore, the inner bag body 21 upswells smoothly by the filling of the liquid. About 20 tons of liquid is contained in the inner bag body 21.

As shown in FIG. 9B, the thickness of the thermal welding lines 35*a* and 35*b* within the section A3 of the inner bag body 21 is approximately uniformed by using the reinforcing film 50. Therefore, approximately uniform welding energy is applied to the section A3 in the thermal welding, the welding line in the thinner part is not damaged by the application of the excessive heat energy. Accordingly, the strength and the durability of the welding line portion are maintained. A welding line portion (A4) is constituted only of the reinforcing film 50 to be two-layered and the thickness thereof is thinner than the section A3. However, since the section A4 is located outside the inner bag body 21, the sealing property, the strength and the durability of the inner bag body 21 are not influenced. In addition, since the thickness of the section A4 is approximately uniform, the approximately uniform strength is obtained, so that the sealing property, the strength and the durability in the section A4 are not lowered.

In the present embodiment, the inner bag body 21 is loaded in the tank body 11 to extend in the longitudinal direction, and its side edge portions are folded inward toward the central line extending in the width direction of it. That prevents the air from entering the inner bag body 21 and the inner bag body 21 can be used for the anaerobic liquid. In addition, since the inner bag body 21 and the inner bag supply-discharge opening 22 are made from LLDPE having high chemical resistance, the tank body 11 has more choices in material. Furthermore, it is unnecessary to line the inner peripheral surface of the tank body 11 with fluorocarbon resin such as polytetrafluoroethylene.

When the inner bag body 21 dwindles to close with the inner bag supply-discharge opening 22 after the remaining amount of the liquid is reduced, the inner bag body 21 may be accidentally sucked into the inner bag supply-discharge opening 22 to cover the opening 22. In order to prevent the inner bag body 21 from covering the inner bag supply-discharge opening 22 in discharging the liquid from the tank supply-discharge opening 15, when the liquid is discharged from the tank supply-discharge opening 15, a passage between the inner bag body 21 and the inner bag supply-discharge opening 22 is ensured by the inner bag suction preventing member 30. The inner bag suction preventing member 30 is integrally constituted of a semi-spherical end 30*b* arranged to protrude toward the inside of the tank body 11, a tubular portion 30*d* whose peripheral surface has plural continuous holes 30*c*, and an attachment flange 30*a* provided on the base part of the tubular portion 30*d*. The semi-spherical end 30*b* protrudes toward the inside of the inner bag body 21, so that the residual liquid in the inner bag body 21 can be surely discharged through the continuous holes 30*c* without the inner bag body 21 stick to the inner bag supply-discharge opening 22.

In addition to the inner bag supply-discharge opening 22, an air vent cap and an air vent valve (not shown) may be welded to the inner bag body 21 at a position corresponding to the hatch 13. In this case, if the air enters the inner bag body 21 by the operation of loading the inner bag body 21 or filling the liquid, the air can be vented in easily.

In the above embodiment, the inner bag body 21 is made from LLDPE, it may be made from LDPE (low-density polyethylene), OP (biaxially oriented polypropylene) and other synthetic resin. In addition, although the inner bag body 21 is doubled in the present embodiment, it may have three ore more layers. Moreover, cylindrical tank body 11 may be formed to have an elliptical shape or others. Furthermore, the inner bag 20 may be used not only for the tank container, but also for a tanker lorry and so forth.

Figure 12:
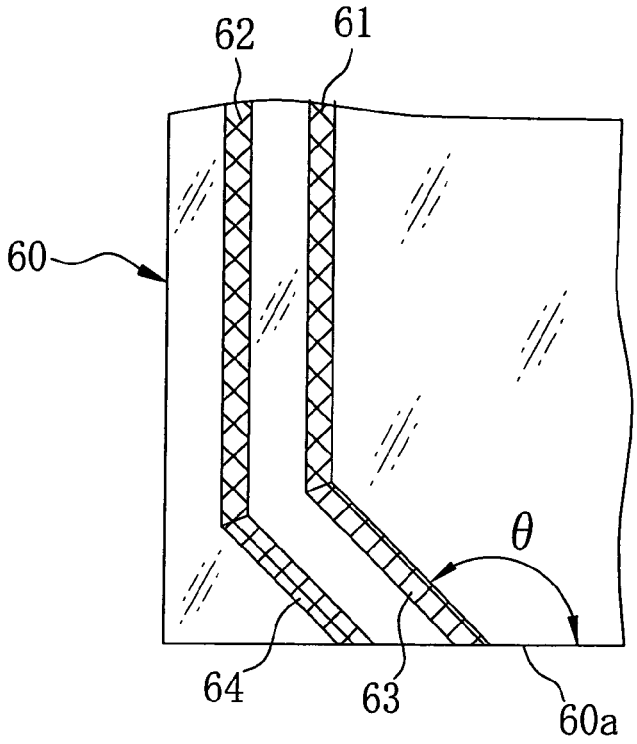
FIG. 12 is a plan view showing an example of an end portion of the thermal welding line in another embodiment of the present invention.
Figure 13:
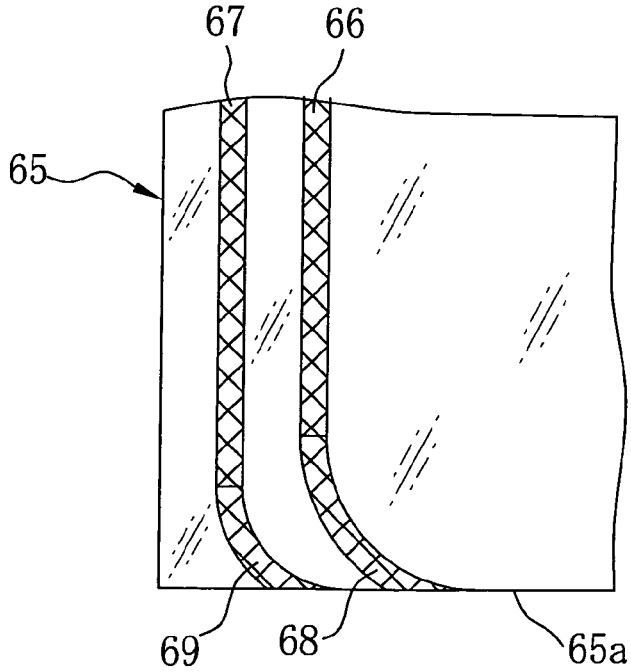
FIG. 13 is a plan view showing another example of the end portion of the thermal welding line in another embodiment of the present invention.

With regard to an inner bag body 60 shown in FIG. 12, both end portions of thermal welding lines 61 and 62 have oblique welding line portions 63 and 64 which turn inward of the inner bag body 60. Meanwhile, both end portions of thermal welding lines 66 and 67 of an inner bag body 65 shown in FIG. 13 have circular-arc welding line portions 68 and 69 instead of the oblique welding line portions 63 and 64. The inclination angle θ of the welding line portions 63 and 64 to both side edges 60*a* of the inner bag body 60 is an obtuse angle, while the welding line portions 68 and 69 contact with both side edges 65*a* of the inner bag body 65 in a circular arc manner. Thereby, the protrusion of the corner portions at both ends caused by the internal liquid pressure becomes small in scale. Moreover, an ear portion, which is an outside portion of the welding line, contacts with the inner surface of the tank body 11, so that it is possible to prevent the welding line portion in the corner portions at both ends from rubbing directly against the material of the inside of the tank body 11. Furthermore, since the force to the weaker sealing portion on the welding line is reduced, the sealing property, the strength and the durability in the corner portion are enhanced. When the welding line portions 63, 64, 68 and 69 are thermally welded, a welding head having a head contact part with the same shape as these welding line portions is used. Note that a welding line portion with a polygonal shape may be used instead of the oblique welding line portions 63 and 64.

Although the reinforcement by both the shape of the thermal welding line and the reinforcing film makes it possible to obtain higher reinforcing effect, it is possible to obtain the reinforcing effect only with the reinforcement by the shape of the thermal welding line, so that the reinforcing film may be omitted. When the thermal welding lines 63, 64, 68 and 69 are formed, it is preferable to put the reinforcing film 50 shown in FIG. 9 on the two-layered portion constituted only of the outer tubular film 23*a* so as to uniform the thickness of the welding line portion. In this case, the sealing property and the strength of the corner portions of the inner bag bodies 60 and 65 can be enhanced further. Each main portion of the thermal welding lines shown in FIGS. 8, 12 and 13 may not be formed linearly, but formed in a circular-arc shape expanding outwardly.

Figure 14:
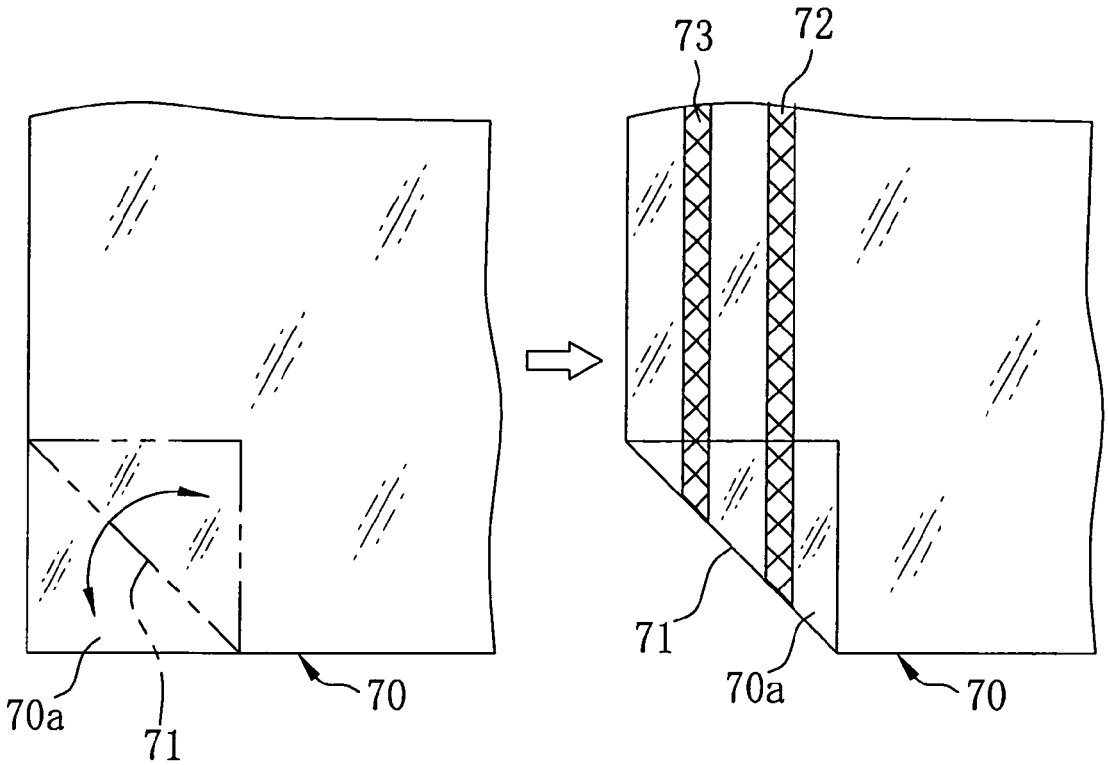
FIG. 14 is a plan view showing an example of the thermal welding line in which one part of the tubular film is used as the reinforcing film in another embodiment of the present invention.
Figure 15:
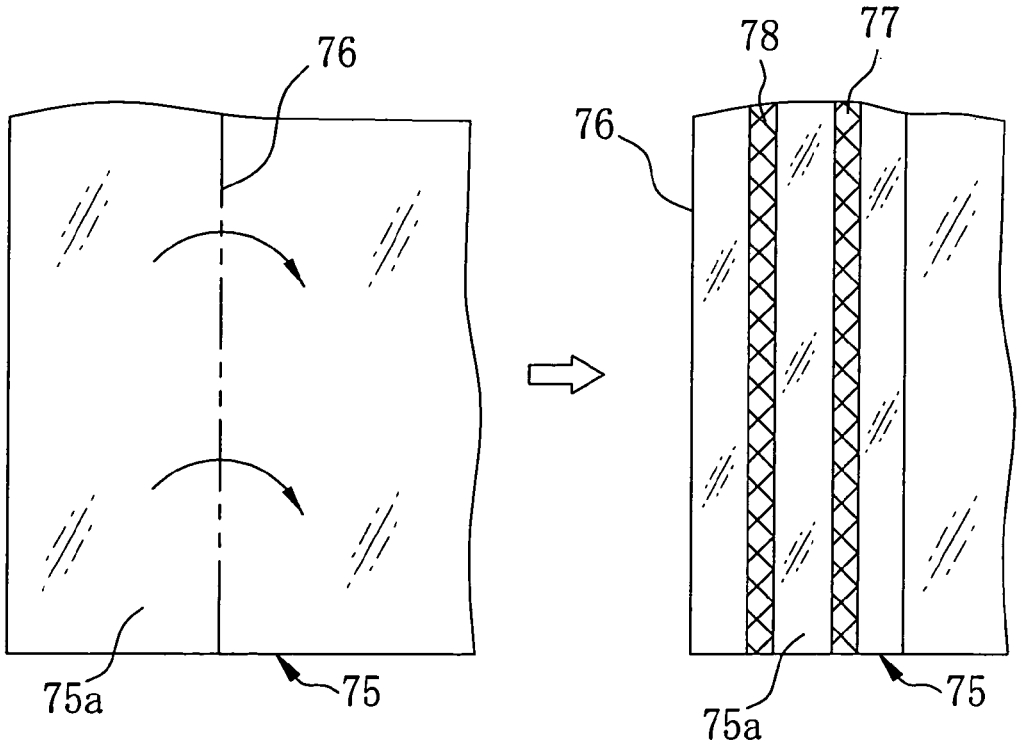
FIG. 15 is a plan view showing another example of the thermal welding line in which one part of the tubular film is used as the reinforcing film in another embodiment of the present invention.

In FIGS. 14 and 15, a part of the inner bag body is used as the reinforcing film without using the separate reinforcing films 50 and 51 other than the inner bag body. In FIG. 14, thermal welding lines 72 and 73 are formed by thermally welding a corner portion 70*a* with it folded along a folding line 71 at both ends of an inner bag body 70. The corner portions 70*a* at both ends become thicker by being folded, so that the corner portion 70*a* is reinforced like the above embodiment. In FIG. 15, thermal welding lines 77 and 78 are formed by thermally welding a portion 75*a* with it folded along a folding line 76 at both ends of an inner bag body 75. The whole thermal welding lines 77 and 78 become thicker to reinforce themselves. Thereby, even if the reinforcing film other than the inner bag body is not used, the corner portions at both ends of the inner bag bodies 70 and 75 can be reinforced by using a portion of these inner bag bodies 70 and 75.

In the flow chart shown in FIG. 4, although the one end portion of the tubular film is welded after the attachment hole for the inner bag supply-discharge opening has been formed in the inner bag body to be attached to the tank supply-discharge opening, the attachment hole may be formed in the inner bag body to be attached to the tank supply-discharge opening after welding the one end portion of the tubular film.

Although the present invention has been fully described by the way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A removable inner bag for a transport tank, comprising: a synthetic-resin multilayer tubular film being constituted of an outer tubular film and an inner tubular film to be inserted into said outer tubular film, and being at least doubled with said outer and inner tubular films, the a synthetic-resin multilayer tubular film having opposing ends along a direction in which the inner tubular film is inserted into said outer tubular film;

a synthetic-resin reinforcing film to be put on corner portions at both ends of said multilayer tubular film;

a welding line where each of the opposing ends of said multilayer tubular film are welded together with said reinforcing film, the welding line sealing said each of the opposing ends to form said multilayer tubular film in an envelope type bag shape; and a second supply-discharge opening, fitting in a first supply-discharge opening disposed in a lower portion of said transport tank, being welded to a peripheral edge of a hole which is formed in said multilayer tubular film before forming said welding line, wherein said reinforcing film is folded and disposed to sandwich a portion constituted only of said outer tubular film at both ends of said welding line.

2. The removable inner bag as claimed in claim 1, wherein said both ends of said welding line have a linear first welding line portion turning inward of said multilayer tubular film.

3. The removable inner bag as claimed in claim 1, wherein said both ends of said welding line have a circular-arc second welding line portion turning inward of said multilayer tubular film.

4. The removable inner bag as claimed in claim 1, wherein said reinforcing film is formed by folding said corner portions at said each of the opposing ends of said multilayer tubular film.

5. An inner bag as claimed in claim 1, wherein length of said multilayer tubular film is IL, width thereof is IW, inner peripheral length of said transport tank in a longitudinal cross-sectional surface in a longitudinal direction is TLt, and the inner peripheral length of said transport tank in the longitudinal cross-sectional surface in a width direction is TLr, the following conditions are satisfied:

$$0.47 \cdot TLt \leqq IL \leqq 0.6 \cdot TLt,$$

$$0.47 \cdot TLr \leqq IW \leqq 0.6 \cdot TLr.$$

* * * * *